US006338829B1

(12) United States Patent
Kodama et al.

(10) Patent No.: US 6,338,829 B1
(45) Date of Patent: Jan. 15, 2002

(54) APPARATUS FOR BREAKING GARBAGE BAGS

(75) Inventors: Kouzou Kodama, Tokyo; Takekazu Takagi, Kanagawa; Makoto Meguro; Shoko Hiwatashi, both of Tokyo, all of (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/251,439

(22) Filed: Feb. 17, 1999

(30) Foreign Application Priority Data

Feb. 18, 1998 (JP) ..... 10-036134

(51) Int. Cl.[7] ..... B65F 7/00

(52) U.S. Cl. ..... 422/261; 241/24.11; 241/79; 241/276; 241/301; 241/606

(58) Field of Search ..... 241/68, 79, 101.01, 241/276, 301, 606, DIG. 38, 24.11, 75, 152.2; 422/243, 261, 309; 34/85, 69; 604/370, 372; 210/660

(56) References Cited

U.S. PATENT DOCUMENTS 5,566,890 A * 10/1996 Ricciardelli ..... 241/20

FOREIGN PATENT DOCUMENTS

| | | |
|---|---|---|
| JP | 56-010406 | 6/1954 |
| JP | 63-175606 | 11/1988 |
| JP | 63-277101 | 11/1988 |
| JP | 63-277102 | 11/1988 |
| JP | 63-20039 | 11/1994 |
| JP | 70-51589 | 2/1995 |
| JP | 91-56622 | 6/1997 |

* cited by examiner

*Primary Examiner*—Elizabeth McKane
(74) *Attorney, Agent, or Firm*—Foley & Lardner

(57) ABSTRACT

An apparatus for breaking garbage bags comprises a bag breaking and a liquid waste processor. The breaker mechanism breaks the input garbage bags containing waste materials. The liquid waste processor includes a removable liquid waste absorbent sheet. This liquid waste absorbent sheet is arranged to absorb liquid waste coming out of the broken garbage bags. The liquid waste absorbent sheet containing the liquid waste is removed for appropriate treatment.

19 Claims, 5 Drawing Sheets

APPARATUS FOR BREAKING GARBAGE BAGS

FIELD OF THE INVENTION

The present invention relates to an apparatus for breaking garbage bags that contain waste materials like food and beverage containers.

BACKGROUND OF THE INVENTION

In conventional processes, waste materials like beverage and food containers are packed in plastic garbage bags and collected in a pit. The bags are broken and the waste materials are separated, recycled or compressed in volume.

Liquid waste coming out of the broken bags has offensive odors and must be cleaned by a considerable amount of water. The water used for cleaning the floor or the pit must be appropriately treated to prevent contamination of the environment.

An object of the present invention is to provide an apparatus for breaking garbage bags, which does not require any cleaning work to cope with liquid waste coming out of the broken garbage bags.

SUMMARY OF THE INVENTION

According to the present invention, there is provided an apparatus for breaking garbage bags, comprising:

a bag breaking mechanism for breaking the Input garbage bags containing waste materials; and a liquid waste processor including a removable liquid waste absorbent sheet that is arranged to absorb liquid waste coming out of the broken garbage bags, wherein said liquid waste absorbent sheet containing the liquid waste is removed.

DESCRIPTION OF THE PREFERRED EMBODIMENT

Figure 1:
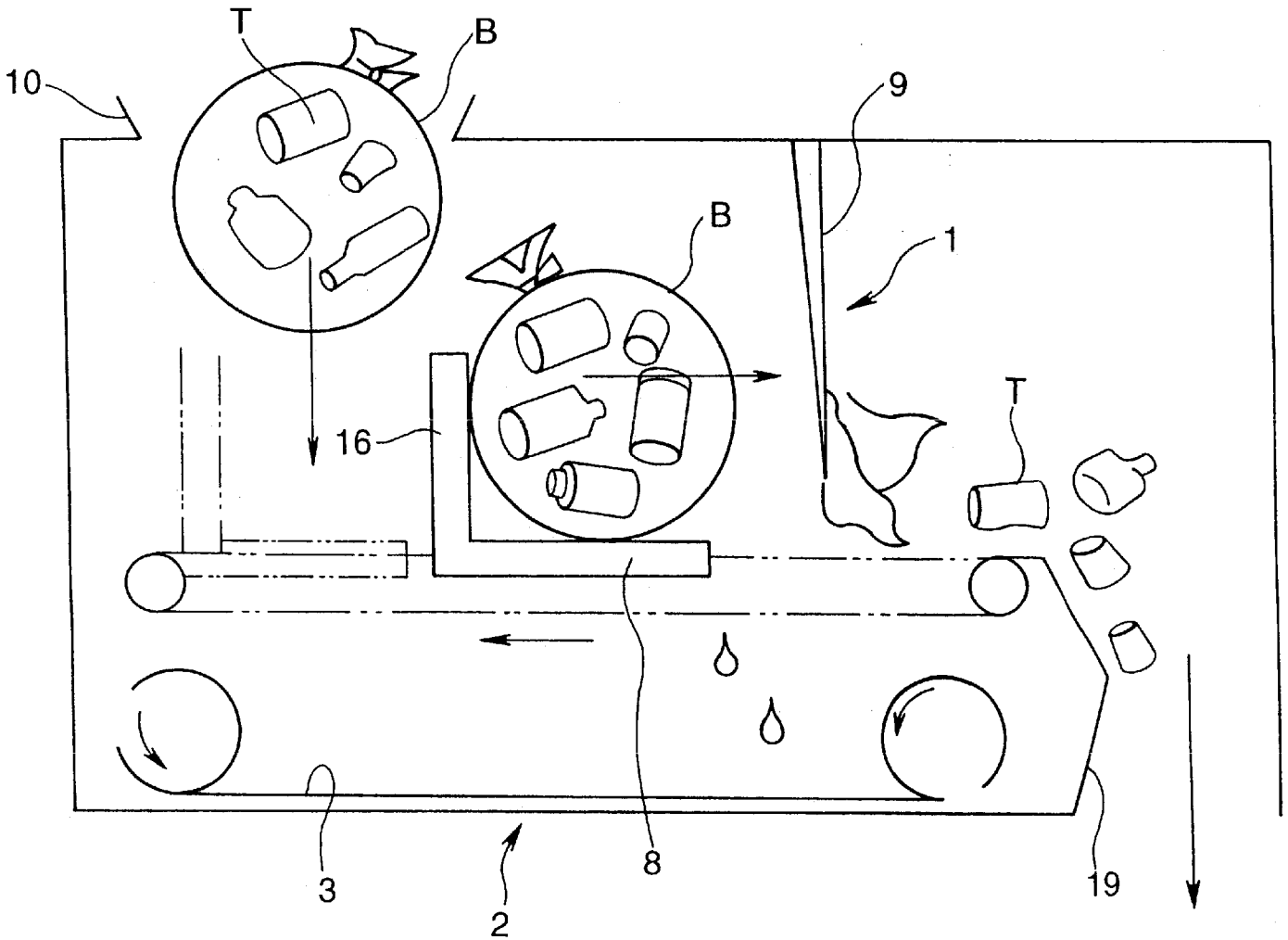
FIG. 1 is a simplified illustration of an apparatus for breaking garbage bags according to the present invention.

Referring to FIG. 1, the reference numeral 1 designates a garbage bag breaking mechanism and the reference numeral 2 a liquid waste processor. The breaking mechanism 1 is a mechanism for breaking garbage bags to allow waste materials to come out of the garbage bags. The water processor 2 includes a liquid waste absorption sheet 3 for absorbing liquid waste coming out of the bags. After absorbing liquid waste, the sheet 3 can be removed for the subsequent disposal or reuse.

Figure 2:
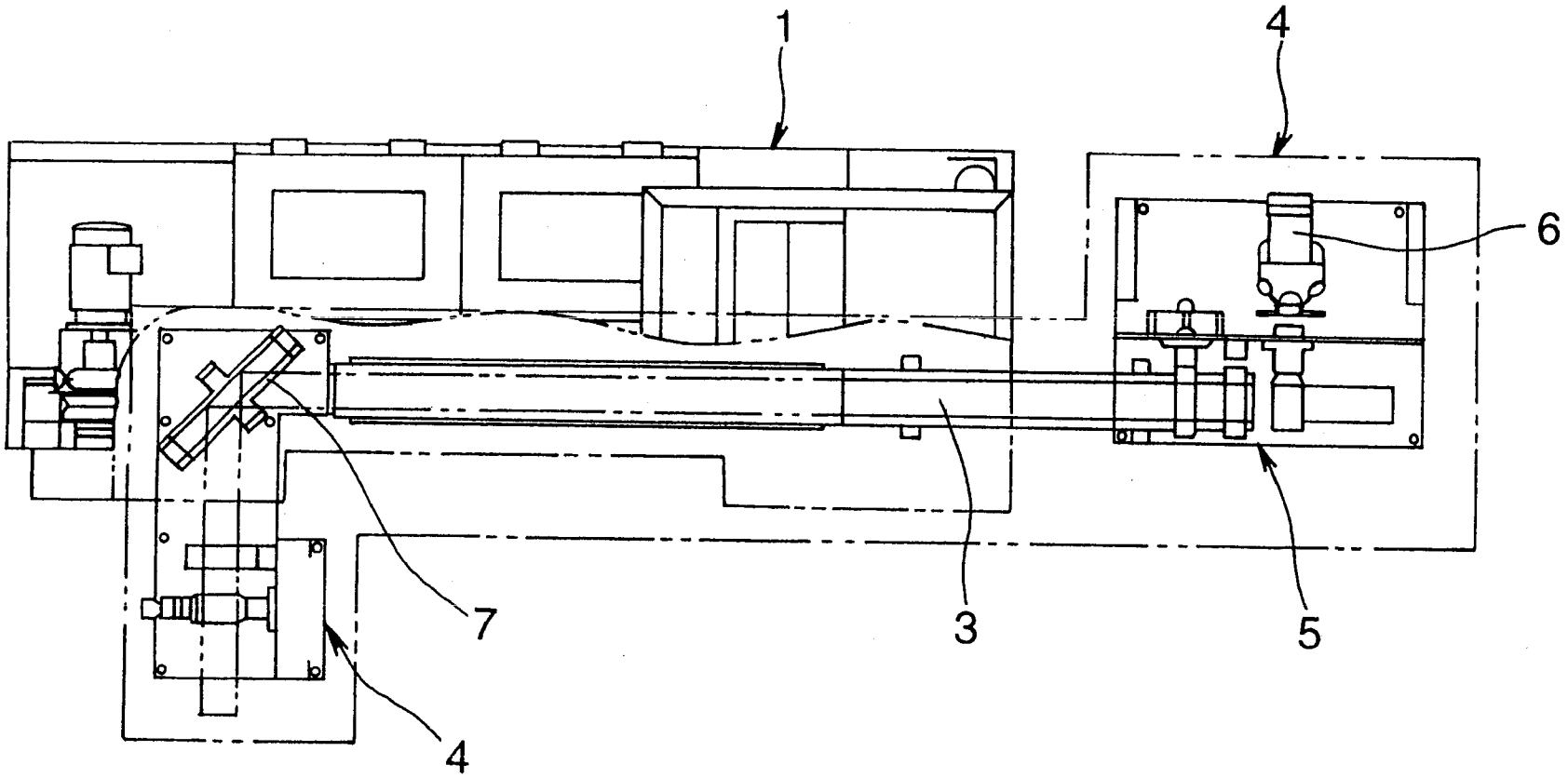
FIG. 2 is a plan view of a preferred implementation of an apparatus for breaking garbage bags.
Figure 3:
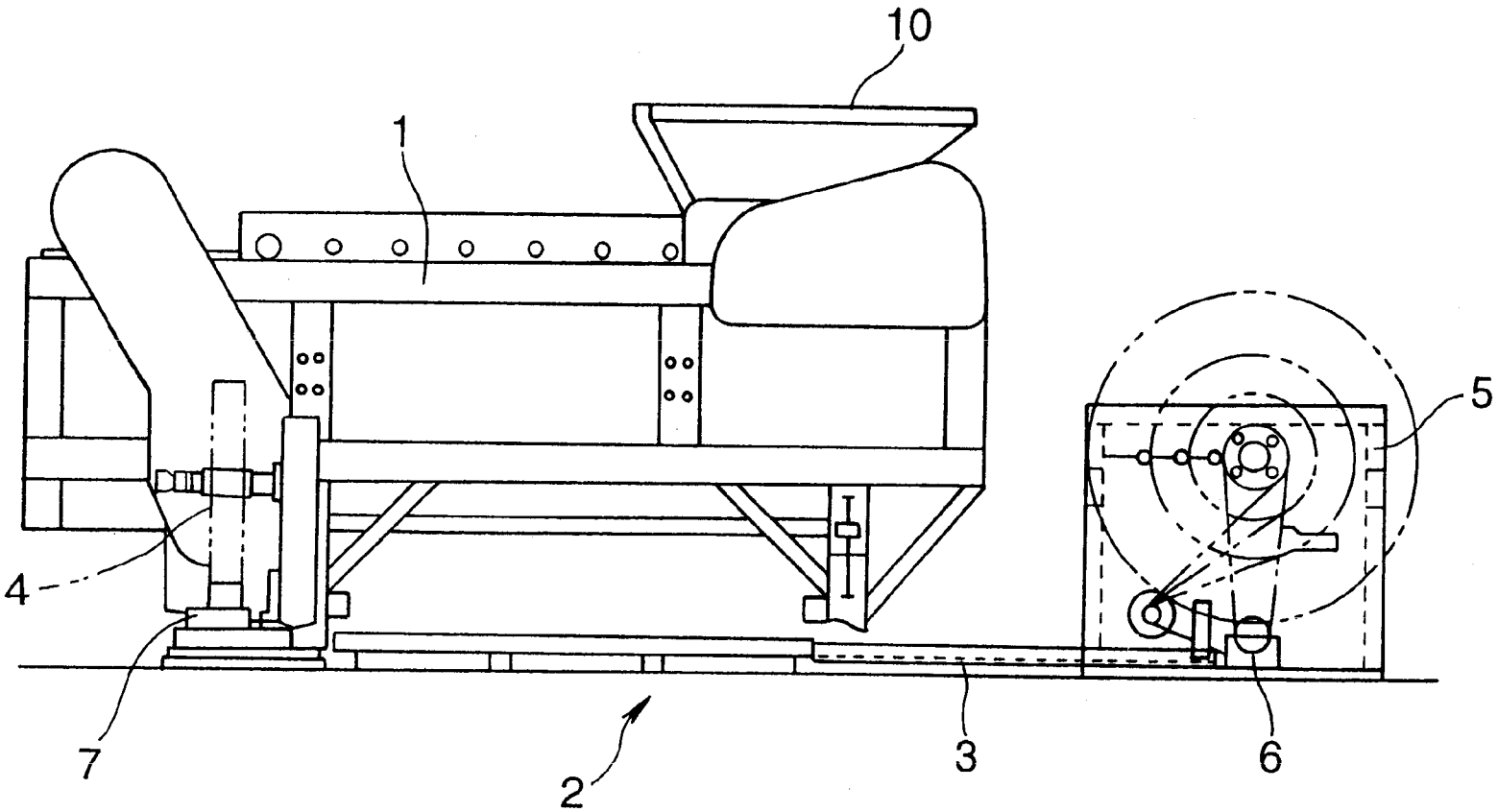
FIG. 3 is a front plan view of the apparatus shown in FIG. 2.

FIGS. 2 and 3 illustrate the preferred implementation according to the present invention. A liquid waste processor 2 in this implementation includes a liquid waste absorption sheet 3 extending below a garbage bag breaking mechanism 1 between a feed reel 4 and a take-up reel 5. A driver 6 is provided to turn the take-up reel 5 continuously or intermittently in a rotational direction to wind up the sheet 3.

The function imposed on the reel 5 is to roll the sheet 3. Thus, the simplest form of the reel is a core which may be turned to roll the sheet.

The liquid waste absorption sheet 3, which is made of polyacrylic acid soda, can absorb water due to osmotic pressure. It can absorb water inward of its resin due to high affinity between hydrophilic group "—COOH" or "—COONa" within high water absorptive resin and water. It is insoluble in water and can absorb and hold water several to 1000 times as much as its own weight.

In FIGS. 2 and 3, a guide roller 7 is positioned between the feed and take-up reels 4 and 5 to change a direction, through 90 degrees, in which the liquid waste absorption sheet 3 is sent. The provision of the guide roller 7 is to cope with restricted Installation space within the apparatus. Preferably, the feed and take-up reels 4 and 5 are at two distant locations spaced along a line along which the liquid waste absorption sheet 3 extends below the bag breaking mechanism 1.

Referring to FIG. 1, the bag breaking mechanism 1 includes a movable portion 8 and a stationary portion 9. The movable portion 8 gives a movement to the input garbage bags B. The stationary portion 9 extends into the path of movement of the garbage bags B to break the bags B Into fragments.

Figure 5:
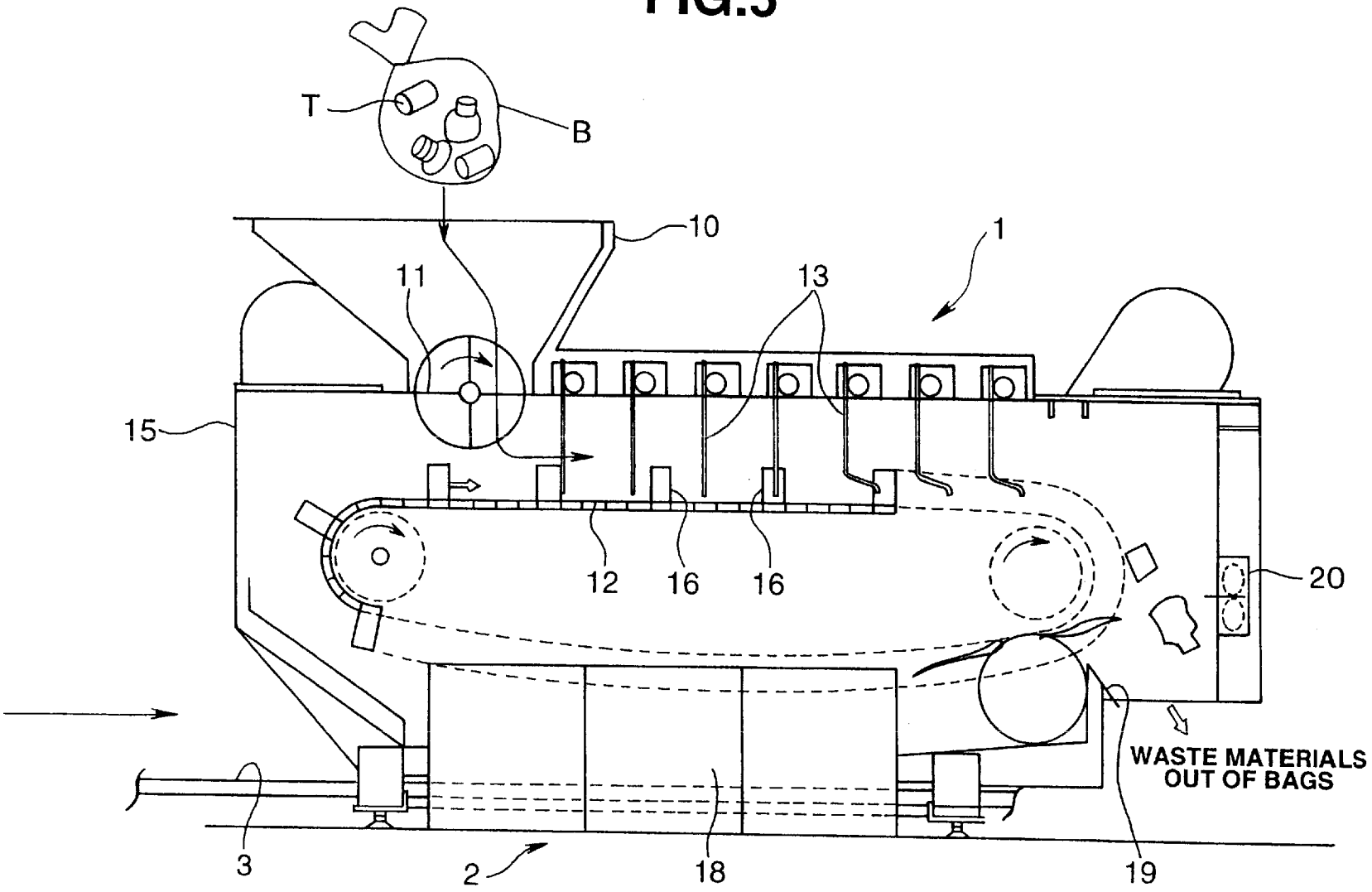
FIG. 5 is an enlarged view of a garbage bag breaking mechanism.

Referring to FIG. 5, the bag breaking mechanism 1 includes, within a frame 15, a hopper 10, a rotary-vane feeder 11, a conveyer 12 and a bag breaker preferably In the form of pawls 13. The hopper 10 has, at its bottom, an aperture positioned above an upstream end of the conveyer 12. The rotary-vane feeder 11 is mounted within the hopper 10. The rotary-vane feeder 11 rotates in one direction and regulates flow of garbage bags B to allow the garbage bags B to drop on the conveyer 12 at a constant rate.

Figure 4:
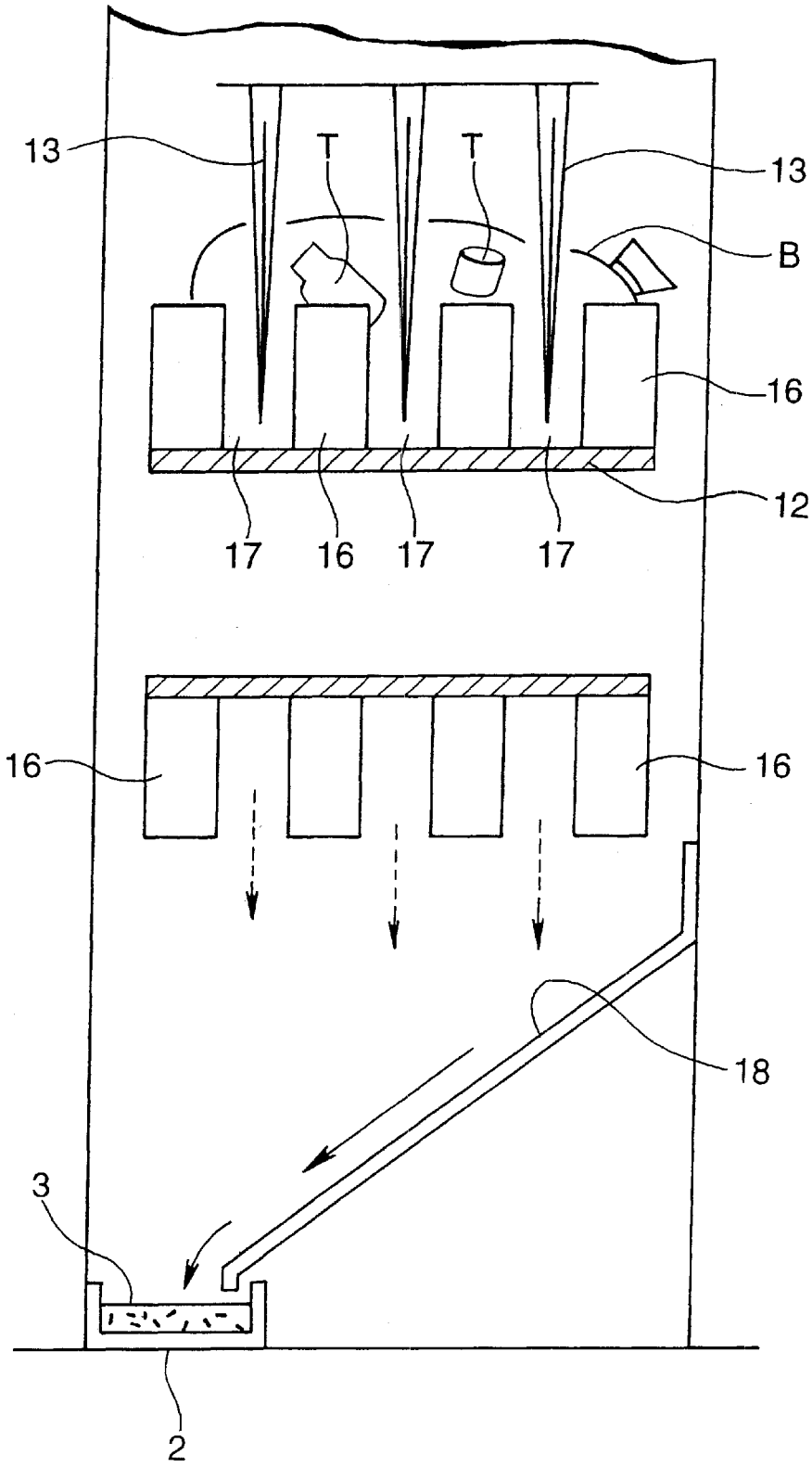
FIG. 4 is a side view, partly broken away, of the apparatus shown in FIG. 2.

The conveyer 12 has attached thereto a plurality of distant support structures 16. The support structures 18 are spaced equidistant along a direction of movement of the conveyer 12. As best seen in FIG. 4, each of the support structures 18 is formed with cutouts 17. The pawls 13 of the stationary portion 9 are suspended over the conveyer 12. The pawls 13 are arranged in at least two trains, which trains are spaced laterally with respect to the direction of movement of the conveyer 12. Each train of pawls 13 is aligned with one of the cutouts 17 of each support structure 18. As shown in FIG. 4, a trough 18 below the conveyer 12 receives liquid waste coming out of the bags B to guide the liquid waste to the water absorbent sheet 3 within the liquid waste processor 2, The trough-like gutter 18 extends obliquely in a downward direction from one side edge of the conveyer 12 toward below the opposite side edge thereof.

The Input garbage bags B, which contain waste materials T, thrown into the hopper 10 are discharged onto the conveyer 12 at a regulated rate determined by rotational speed of the rotary-vane feeder 11. Each of the bags B that have been dropped onto the conveyer 12 between the adjacent two support structures 16 are transported in the one direction and come into engagement with the claws 13 to be broken into fragments. The conveyer 12 transports the waste materials coming out of the broken bag B. It has been confirmed that some garbage bags B were partially damaged by the vanes of the feeder 11 but the damaged bags B did not discharge the waste materials T upon being dropped onto the conveyer 12.

The waste materials T drops from a terminal end of the conveyer 12 into a chute 19. A fan 20 is mounted adjacent the terminal end or the conveyer 12 and operative to send air to the surface of the conveyer 12 from the terminal end thereof, thereby to separate the fragments of the bags B and the waste materials 1.

Liquid waste coming out of the broken bags B drops down from the conveyer 12 onto the trough-like gutter 18. Then, the liquid waste flows along the trough-like gutter 18 down to the liquid waste absorbent sheet 3. The liquid waste absorbent sheet 3 can absorb all of the liquid waste coming from the trough-like gutter 18.

The take-up reel 5 winds a portion of the liquid waste absorbent sheet 3 that has absorbed the liquid waste, while the feed reel 4 supplies fresh portion of the liquid waste absorbent sheet 3 under the conveyer 12. The liquid waste absorbent sheet 3 that has absorbed the liquid waste is removed from the take-up reel 5 for appropriate treatment to the subsequent disposal or reuse.

The rate at which the liquid waste absorbent sheet 3 is supplied to below the conveyer 12 by the feed reel 4 is determined on the estimated amount of liquid waste coming out of the garbage bags B and the absorbent performance of the sheet 3. The supply may be intermittent or continuous.

The above-described preferred implementation of the present invention is an example implementation. Moreover various modifications to the present invention may occur to those skilled in the art and will fall within the scope of the present invention as set forth below.

What is claimed is:

1. An apparatus for breaking garbage bags, comprising;

a bag breaking mechanism for breaking the input garbage bags containing waste materials, including a moveable portion for moving the input garbage bags along a predetermined path, and a stationary portion extending into the predetermined path of movement of the input garbage bags for engagement therewith to break the garbage bags; and a liquid waste processor including a removable liquid waste absorbent sheet that is arranged to absorb liquid waste coming out of the broken garbage bags, wherein said liquid waste absorbent sheet containing the liquid waste may be removed to dispose of the liquid waste.

2. The apparatus as claimed in claim 1, wherein said liquid waste absorbent sheet extends below said bag breaking mechanism.

3. The apparatus as claimed in claim 2, wherein said movable portion includes a conveyer to give the input garbage bags movement along the predetermined path, said conveyer having a plurality of spaced stationary supports for the input garbage bags, and said stationary portion includes a plurality of claws for breaking the garbage bags on the conveyer;

and wherein said liquid waste absorbent sheet is arranged to absorb the liquid waste coming out of the broken bags and dropped down from the conveyor.

4. The apparatus as claimed in claim 3, wherein said liquid waste absorbent sheet extends below the garbage bags and along said predetermined path of the movement of the garbage bags.

5. The apparatus as claimed in claim 3, wherein said liquid waste absorbent sheet is arranged to move continuously or intermittently.

6. The apparatus as claimed in claim 3, further comprising a take-up reel arranged to wind up that portion of said liquid waste absorbent sheet which has absorbed the liquid waste to a sufficient level for the subsequent removal therefrom for appropriate treatment.

7. The apparatus as claimed in claim 3, wherein the liquid waste absorbent sheer is capable of absorbing and holding water several to 1000 times as much as its own weight.

8. The apparatus as claimed in claim 2, wherein said liquid waste absorbent sheet extends below the garbage bags and along said predetermined path of the movement of the garbage bags.

9. The apparatus as claimed in claim 2, wherein said liquid waste absorbent sheet is arranged to move continuously or intermittently.

10. The apparatus as claimed in claim 2, further comprising a take-up reel arranged to wind up that portion of said liquid waste absorbent sheet which have adsorbed the liquid waste to a sufficient level for the subsequent removal therefrom for appropriate treatment.

11. The apparatus as claimed in claim 2, wherein the liquid waste absorbent sheet is capable of absorbing and holding water several to 1000 times as much as its own weight.

12. The apparatus as claimed in claim 1, wherein the liquid waste absorbent sheet is capable of absorbing and holding water several to 1000 times as much as its own weight.

13. An apparatus for breaking garbage bags, comprising;

a bag breaking mechanism for breaking the input garbage bags containing waste materials, and a liquid waste processor including a removable liquid waste absorbent sheet that extends below said bag breaking mechanism and is arranged to absorb liquid waste dropped down from the broken garbage bags, wherein said liquid waste absorbent sheet containing the liquid waste may be removed to dispose of the liquid waste.

14. The apparatus as claimed in claim 13, wherein said bag breaking mechanism includes a moveable portion for giving movement of the input garbage bags along a predetermined path, and a stationary portion extending into the path of the movement of the input garbage bags for engagement therewith to break the garbage bags.

15. The apparatus as claimed in claim 14, wherein said movable portion includes a conveyer to give the input garbage bags movement along the predetermined path, said conveyer having a plurality of spaced stationary supports for the input garbage bags, and said stationary portion includes a plurality of claws for breaking the garbage bags on the conveyer.

16. The apparatus as claimed in claim 13, wherein said liquid waste absorbent sheet extends below the garbage bags and along a predetermined path of the movement of the garbage bags.

17. The apparatus as claimed in claim 13, wherein said liquid waste absorbent sheet is arranged to move continuously or intermittently.

18. The apparatus as claimed in claim 13, further comprising a take-up reel arranged to wind up that portion of said liquid waste absorbent sheet which has absorbed the liquid waste to a sufficient level for the subsequent removal therefrom for appropriate treatment.

19. The apparatus as claimed in claim 13, wherein the liquid waste absorbent sheet is capable of absorbing and holding water several to 1000 times as much as its own weight.

* * * * *